US012290146B2

(12) United States Patent
Takamasu et al.

(10) Patent No.: US 12,290,146 B2
(45) Date of Patent: May 6, 2025

(54) SOLE OF SHOE AND SHOE

(71) Applicant: ASICS CORPORATION, Kobe (JP)

(72) Inventors: Sho Takamasu, Hyogo (JP); Seiji Yano, Hyogo (JP); Hiroki Nakamura, Hyogo (JP)

(73) Assignee: ASICS CORPORATION, Kobe (JP)

( * ) Notice: Subject to any disclaimer, the term of this patent is extended or adjusted under 35 U.S.C. 154(b) by 28 days.

(21) Appl. No.: 18/305,783

(22) Filed: Apr. 24, 2023

(65) Prior Publication Data

US 2023/0346070 A1 Nov. 2, 2023

(30) Foreign Application Priority Data

Apr. 28, 2022 (JP) ..... 2022-074392

(51) Int. Cl.
*A43B 7/142* (2022.01)
*A43B 7/1445* (2022.01)
(Continued)

(52) U.S. Cl.
CPC ..... *A43B 7/142* (2013.01); *A43B 7/1445* (2013.01); *A43B 7/149* (2013.01); *A43B 7/24* (2013.01); *A43B 5/002* (2013.01); *A43B 5/06* (2013.01)

(58) Field of Classification Search
CPC ..... A43B 7/142; A43B 7/24; A43B 13/125; A43B 13/186; A43B 13/188; A43B 13/14
See application file for complete search history.

(56) References Cited

U.S. PATENT DOCUMENTS 6,591,519 B1 * 7/2003 Ellis, III ..... A43B 13/143 36/31
6,658,766 B2 * 12/2003 Kraeuter ..... A43B 5/00 36/102

(Continued)

FOREIGN PATENT DOCUMENTS

EP 3 939 461 A1 1/2022
EP 4122348 A1 1/2023

(Continued)

OTHER PUBLICATIONS

The extended European search report issued by the European Patent Office on Aug. 29, 2023, which corresponds to European Patent Application No. 23170299.4-1015 and is related to U.S. Appl. No. 18/305,783.

(Continued)

*Primary Examiner* — Ted Kavanaugh
(74) *Attorney, Agent, or Firm* — Studebaker Brackett PLLC

(57) ABSTRACT

A sole of a shoe includes a forefoot support portion R1 that supports a forefoot of a foot of a wearer, a midfoot support portion that supports a midfoot of the foot of the wearer, and a rearfoot support portion that supports a rearfoot of the foot of the wearer, which are connected in order from a front side toward a rear side. A ground contact portion having a portion positioned on a lowermost line connecting a lowermost point of the forefoot support portion and a lowermost point of the rearfoot support portion in a side view is formed in a medial-foot-side region of a bottom surface of the midfoot support portion. A protrusion protruding toward the medial foot side is formed on a medial-foot-side side surface of the midfoot support portion.

10 Claims, 8 Drawing Sheets

(51) Int. Cl.

| | |
|---|---|
| ***A43B 7/149*** | (2022.01) |
| ***A43B 7/24*** | (2006.01) |
| *A43B 5/00* | (2022.01) |
| *A43B 5/06* | (2022.01) |

(56) References Cited

U.S. PATENT DOCUMENTS

| | | | | |
|---|---|---|---|---|
| 6,662,470 | B2 * | 12/2003 | Ellis, III | A43B 13/18 36/25 R |
| 8,938,889 | B2 * | 1/2015 | Rosa | A43B 7/24 36/31 |
| 2005/0210705 | A1 * | 9/2005 | Grove | A43B 3/24 36/28 |
| 2005/0217142 | A1 * | 10/2005 | Ellis, III | A43B 13/36 36/25 R |
| 2007/0240331 | A1 * | 10/2007 | Borel | A43B 13/026 36/28 |
| 2008/0052965 | A1 * | 3/2008 | Sato | A43B 13/026 36/103 |
| 2012/0137544 | A1 | 6/2012 | Rosa et al. | |
| 2019/0142103 | A1 | 5/2019 | Christensen et al. | |
| 2022/0015499 | A1 | 1/2022 | Nakamura et al. | |

FOREIGN PATENT DOCUMENTS

| | | | |
|---|---|---|---|
| JP | 2004-242692 | A | 9/2004 |
| WO | 2022/074845 | A1 | 4/2022 |

OTHER PUBLICATIONS

Communication pursuant to Article 94(3) EPC issued by the European Patent Office on May 8, 2024, which corresponds to European Patent Application No. 23170299.4-1015 and is related to U.S. Appl. No. 18/305,783.

* cited by examiner

SOLE OF SHOE AND SHOE

CROSS-REFERENCE TO RELATED APPLICATIONS

The present application claims priority to and incorporates by reference the entire contents of Japanese Patent Application No. 2022-074392 filed in Japan on Apr. 28, 2022.

BACKGROUND OF THE INVENTION

1. Field of the Invention

The present invention relates to a sole of a shoe and a shoe.

2. Description of the Related Art

When a human runs, the foot falls inward at the same time as landing, and the medial longitudinal arch of the foot collapses. This series of foot movements is also called pronation and is known as natural foot movements for dispersing an impact during landing. However, if the foot falls too far inward, that is, overpronation occurs, the landing tends to be unstable, applying a greater strain to the leg muscles, joints, and knees.

For this reason, conventional techniques for controlling excessive pronation are known (see, for example, JP 2004-242692 A and US 2019/0142103 A).

However, the shoes disclosed in JP 2004-242692 A and US 2019/0142103 A do not consider overpronation under increased fatigue due to running.

SUMMARY OF THE INVENTION

In order to solve the above problem and achieve the object, a sole of a shoe comprising: a forefoot support portion supporting a forefoot of a foot of a wearer; a midfoot support portion supporting a midfoot of the foot of the wearer; and a rearfoot support portion supporting a rearfoot of the foot of the wearer, the forefoot support portion, the midfoot support portion, and the rearfoot support portion being connected in order from a front side toward a rear side, wherein a ground contact portion having a portion positioned on a lowermost line connecting a lowermost point of the forefoot support portion and a lowermost point of the rearfoot support portion in a side view is formed in a medial-foot-side region of a bottom surface of the midfoot support portion, and a protrusion protruding toward a medial foot side is formed on a medial-foot-side side surface of the midfoot support portion.

DETAILED DESCRIPTION OF THE PREFERRED EMBODIMENTS

Hereinafter, embodiments of a sole of a shoe and a shoe according to the present invention will be described in detail with reference to the drawings. Note that the present invention is not limited by the embodiments. In the following description, the same portions are denoted by the same reference signs, and redundant description will be omitted.

First Embodiment

Figure 1:
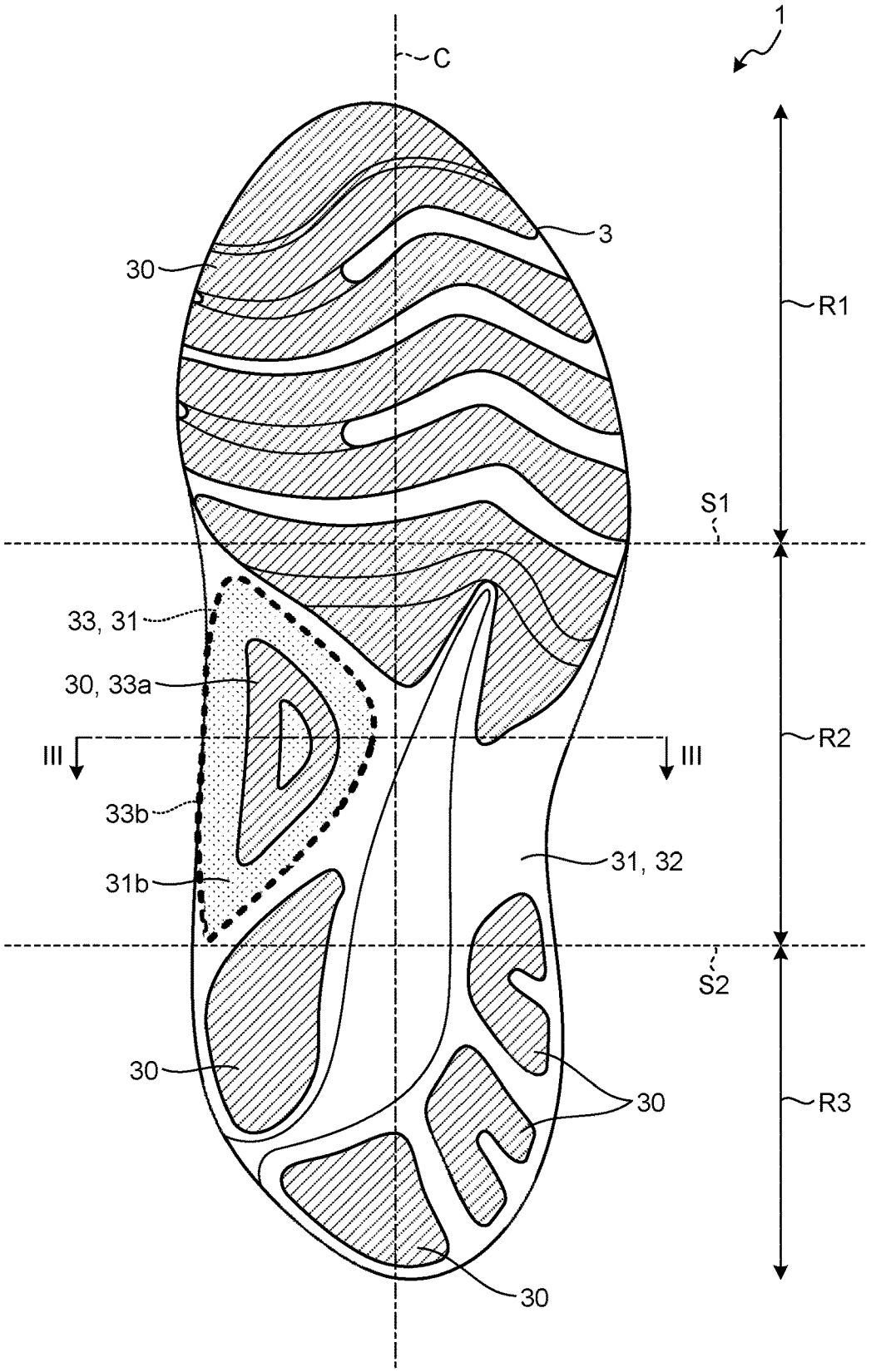
FIG. 1 is a bottom view of a shoe according to a first embodiment of the present invention.

FIG. 1 is a bottom view of a shoe 1 according to a first embodiment of the present invention. In the drawings including FIG. 1, only the shoe 1 for a left foot is illustrated. Since the shoe 1 has a left-right symmetrical structure for a left foot and a right foot, only the shoe 1 for a left foot is described in the present embodiment, and the description of the shoe 1 for a right foot is omitted. In the following description, a direction in which a shoe center axis C, which is a perpendicular line passing through the center of shoe 1 in a bottom view of the shoe 1, extends is referred to as a front-rear direction, and a direction orthogonal to the front-rear direction in the bottom view of the shoe 1 is referred to as a foot width direction.

In the following description, a direction from the heel toward the toe of the shoe 1 in the front-rear direction is referred to as a front, and a direction from the toe toward the heel of the shoe 1 in the front-rear direction is referred to as a rear.

In the following description, a median side of a foot in the anatomical position is referred to as a medial foot side, and the side opposite to the median side of the foot in the anatomical position is referred to as a lateral foot side. That is, the side closer to the median line in the anatomical position is referred to as the medial foot side, and the side farther from the median line in the anatomical position is referred to as the lateral foot side.

In the following description, a vertical direction means a direction orthogonal to both the front-rear direction and the foot width direction unless otherwise specified.

A sole 3 includes a forefoot support portion R1 that supports the forefoot of a foot of a wearer with a standard body shape, a midfoot support portion R2 that supports the midfoot of a foot of a wearer with a standard body shape, and a rearfoot support portion R3 that supports the rearfoot of a foot of a wearer with a standard body shape. The forefoot support portion R1, the midfoot support portion R2, and the rearfoot support portion R3 are connected in order from the front side toward the rear side of the sole 3.

A line along the foot width direction passing through a position corresponding to about 37% of the dimension of the sole 3 from the front end of the sole 3 in the front-rear direction is defined as a first boundary line S1, and a line along the foot width direction passing through a position corresponding to about 71% of the dimension of the sole 3 from the front end of the sole 3 in the front-rear direction is defined as a second boundary line S2. The first boundary line S1 is a line roughly along the MP joint of a wearer with a standard body shape. The second boundary line S2 is a line roughly along the Chopart joint of a wearer with a standard body shape. The forefoot support portion R1 is positioned in front of the first boundary line S1. The midfoot support portion R2 is positioned between the first boundary line S1 and the second boundary line S2. The rearfoot support portion R3 is positioned behind the second boundary line S2.

Figure 2:
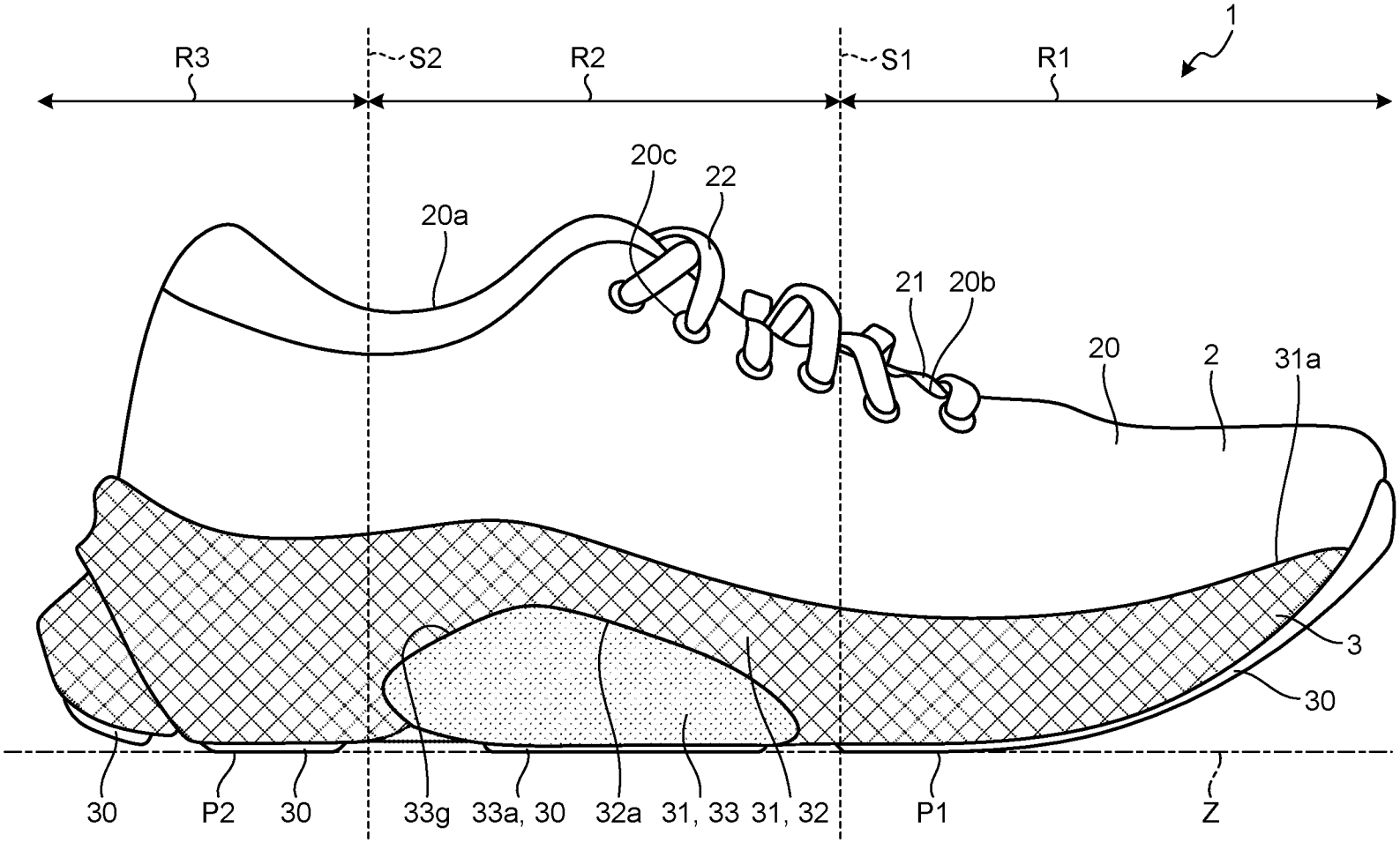
FIG. 2 is a medial-foot-side side view of the shoe according to the first embodiment of the present invention.

FIG. 2 is a medial-foot-side side view of the shoe 1 according to the first embodiment of the present invention. The shoe 1 is preferably a running shoe but may be a shoe for other sports, a walking shoe, a climbing shoe, or the like. The shoe 1 includes an upper 2 and the sole 3.

The upper 2 is positioned above the sole 3. The upper 2 includes an upper body 20, a shoe tongue 21, and a shoelace 22.

The upper body 20 covers an instep side part of a foot of a wearer. The upper body 20 is formed with a foot insertion opening 20*a* and a throat portion 20*b* at its upper portion. The foot insertion opening 20*a* is an opening for inserting the foot of the wearer into the upper body 20. The throat portion 20*b* is an opening communicating with the foot insertion opening 20*a* and extending to the front side from the foot insertion opening 20*a*. On both side edges of the throat portion 20*b* in the foot width direction, a plurality of string passing portions 20*c* spaced apart from each other in the front-rear direction is provided. FIG. 2 illustrates only the string passing portions 20*c* provided on the medial-foot-side side edge of the throat portion 20*b*. The string passing portions 20*c* are only required to allow the shoelace 22 to pass through. The string passing portions 20*c* are, for example, through holes that pass through the upper body 20 in the vertical direction.

The shoe tongue 21 is a member for protecting the instep of the wearer. The shoe tongue 21 covers the throat portion 20*b* inside the upper body 20. The shoe tongue 21 is fixed to the upper body 20 by stitching, welding, bonding, or a combination thereof. The material of the upper body 20 and the shoe tongue 21 is, for example, woven fabric, knitted fabric, synthetic leather, or resin. In the shoe 1 required to have air permeability and lightweight property, the material of the upper body 20 and the shoe tongue 21 is preferably a double raschel warp knitted fabric knitted with polyester yarn. Note that the material of the upper body 20 and the shoe tongue 21 is not limited to those exemplified.

The shoelace 22 is a string-like member that is alternately passed through the string passing portions 20*c* provided at one side edge of the throat portion 20*b* in the foot width direction and the string passing portions 20*c* provided at the other side edge in the foot width direction. The shoelace 22 is detachably attached to the upper body 20.

In the present embodiment, the upper 2 including the shoe tongue 21 and the shoelace 22 is described as an example, but the upper 2 may have a monosock structure in which a portion corresponding to the shoe tongue 21 is integrated with an ankle portion of the upper body 20. In addition, a hook-and-loop fastener may be used instead of the shoelace 22 to bring the upper body 20 into close contact with the foot. If a hook-and-loop fastener is used to bring the upper body 20 into close contact with the foot, the string passing portions 20*c* are not formed in the upper body 20.

The sole 3 is positioned below the upper 2. The sole 3 covers the sole of the wearer. The sole 3 is fixed to the upper 2 by stitching, welding, bonding, or a combination thereof. The sole 3 includes an outsole 30 and a midsole 31. The sole 3 includes an inner sole (not illustrated) that covers the lower opening of the upper body 20. The inner sole is fixed to the upper surface of the midsole 31 by bonding or welding. The inner sole is fixed to the lower edge of the upper body 20 by stitching. Although not illustrated, the shoe 1 may include an insole. If the shoe 1 includes an insole, the insole is installed on the sole 3 inside the upper 2. The sole 3 may have a structure in which the inner sole is omitted.

The midsole 31 is positioned on the upper surface of the outsole 30. The midsole 31 is positioned between the upper 2 and the outsole 30. The midsole 31 is a soft member having a smaller Young's modulus than the outsole 30. The midsole 31 has a cushioning property. The midsole 31 is disposed over the entire region of the forefoot support portion R1, the midfoot support portion R2, and the rearfoot support portion R3. The midsole 31 has a first midsole portion 32 and a second midsole portion 33. Note that, in FIG. 2, the first midsole portion 32 is diamond-hatched, and the second midsole portion 33 is dot-hatched in order to facilitate understanding.

The second midsole portion 33 is formed separately from the first midsole portion 32. The second midsole portion 33 is fixed to the first midsole portion 32 by welding, adhesion, or a combination thereof. The hardness of the second midsole portion 33 is lower than the hardness of the first midsole portion 32. By making the material of the first midsole portion 32 different from the material of the second midsole portion 33, The hardness of the first midsole portion 32 and the hardness of the second midsole portion 33 can be made different. The material of the first midsole portion 32 and the material of the second midsole portion 33 are, for example, a resin foam material and a rubber foam material.

The first midsole portion 32 is disposed over the entire region of the forefoot support portion R1, the midfoot support portion R2, and the rearfoot support portion R3. The second midsole portion 33 is disposed below a portion of the first midsole portion 32 positioned in the midfoot support portion R2. Specifically, a cutout 32*a* recessed upward is formed in a lower surface of the portion of the first midsole portion 32 positioned in the midfoot support portion R2, and the second midsole portion 33 is disposed in the cutout 32*a*. The cutout 32*a* opens downward and toward the medial foot side. The side view shape of an upper surface 33*g* of the second midsole portion 33 is a curved shape protruding upward. The side view shape of the upper surface 33*g* of the second midsole portion 33 is a shape along the medial longitudinal arch of the foot or a shape approximating the medial longitudinal arch of the foot.

In FIG. 1, the outer shape of the second midsole portion 33 is indicated by a broken line, the second midsole portion 33 is dot-hatched, and the outsole 30 is diagonal-hatched in order to facilitate understanding. As illustrated in FIG. 1, the second midsole portion 33 is disposed only in a medial-foot-side region of the midfoot support portion R2 in the present embodiment. The second midsole portion 33 is only required to be disposed at least in a medial-foot-side region of the midfoot support portion R2. The second midsole portion 33 is only required to be disposed below at least a part or all of the medial longitudinal arch of the foot. The bottom surface of the second midsole portion 33 is a medial-foot-side region of the bottom surface of the midfoot support portion R2. The second midsole portion 33 is deformed by receiving the load when the shoe 1 comes contact with the ground to absorb an impact when the shoe 1 comes into contact with the ground. The bottom view shape of the second midsole portion 33 is a triangular shape in which the width in the front-rear direction narrows from the medial foot side toward the lateral foot side in the present embodiment.

The second midsole portion 33 includes a ground contact portion 33*a* that comes into contact with the ground. The ground contact portion 33*a* is formed on the bottom surface of the second midsole portion 33. The ground contact portion 33*a* is the outsole 30 attached to the bottom surface of the second midsole portion 33 in the present embodiment. The ground contact portion 33*a* is positioned below the medial longitudinal arch of the foot. The position of the ground contact portion 33*a* in the front-rear direction is preferably within a region of 30% to 60% of the dimension of the sole 3 in the front-rear direction from the rear end of the sole 3. The position of the ground contact portion 33*a* in the foot width direction is preferably positioned on the medial foot side relative to the shoe center axis C. As illustrated in FIG. 2, the ground contact portion 33*a* has a portion positioned on a lowermost line Z along the front-rear direction connecting a lowermost point P1 of the forefoot support portion R1 and a lowermost point P2 of the rearfoot support portion R3 in a side view.

Figure 3:
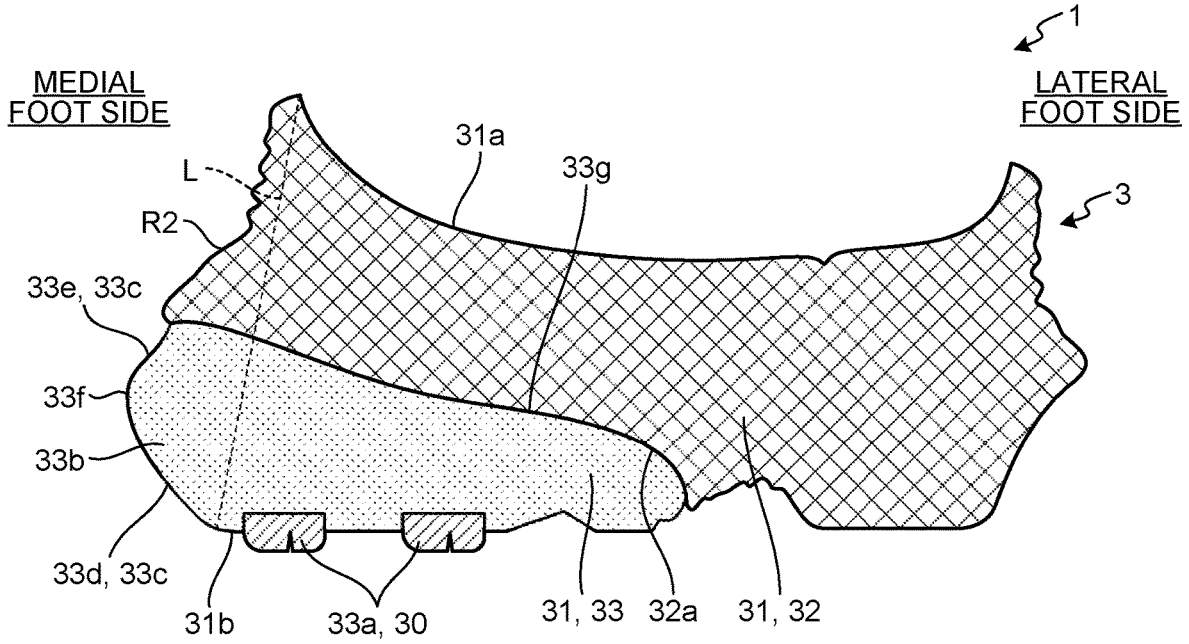
FIG. 3 is a cross-sectional view taken along line III-III in FIG. 1.

FIG. 3 is a cross-sectional view taken along line III-III in FIG. 1. The medial-foot-side side surface of the second midsole portion 33 is the medial-foot-side side surface of the midfoot support portion R2. The medial-foot-side side surface of the second midsole portion 33 is formed with a protrusion 33*b* protruding toward the medial foot side. The protrusion 33*b* is formed over the entire length of the medial-foot-side side surface of the second midsole portion 33. The protrusion 33*b* is preferably in a region ranging from 30% to 60% of the dimension of the sole 3 in the front-rear direction from the rear end of the sole 3. The protrusion 33*b* includes a protruding end surface 33*c* facing the medial foot side. The protruding end surface 33*c* has a first protruding end surface 33*d* and a second protruding end surface 33*e*. The first protruding end surface 33*d* extends upward from the medial-foot-side edge of a bottom surface 31*b* of the midsole 31 (the bottom surface of the second midsole portion 33) so as to be positioned toward the medial foot side. The second protruding end surface 33*e* is continuous with the first protruding end surface 33*d* and extends upward so as to be positioned toward the lateral foot side.

The boundary between the first protruding end surface 33*d* and the second protruding end surface 33*e* is a vertex 33*f* of the protrusion 33*b* positioned on the medial-most foot side. The vertex 33*f* is a point of the protruding end surface 33*c* where the inclination direction is switched. The vertex 33*f* extends in the front-rear direction. When a straight line connecting the medial-foot-side edge of an upper surface 31*a* of the midsole 31 (the upper surface of the first midsole portion 32) and the medial-foot-side edge of the bottom surface 31*b* of the midsole 31 (the bottom surface of the second midsole portion 33) is defined as a virtual straight line L, the vertex 33*f* of the protrusion 33*b* is preferably positioned on the medial foot side relative to the virtual straight line L and below the center of the virtual straight line L in the vertical direction. The upper surface 33*g* of the second midsole portion 33 is inclined downward from the medial foot side toward the lateral foot side. In other words, the cross-sectional shape of the upper surface 33*g* of the second midsole portion 33 along the foot width direction is an inclined shape inclined downward from the medial foot side toward the lateral foot side.

As illustrated in FIG. 2, the outsole 30 is disposed below the midsole 31. The outsole 30 is a hard member having a larger Young's modulus than the midsole 31. The material of the outsole 30 is, for example, a material containing rubber as a main component and secondary components. Examples of the secondary components include a plasticizer, a reinforcing agent, and a crosslinking agent. As illustrated in FIG. 1, the outsole 30 is partially disposed in the forefoot support portion R1, the midfoot support portion R2, and the rearfoot support portion R3. The outsole 30 is partially attached to the bottom surface 31*b* of the midsole 31. In the present embodiment, a part of the outsole 30 disposed in the midfoot support portion R2 serves as the ground contact portion 33*a*. The outsole 30 serving as the ground contact portion 33*a* and the other outsole 30 are provided independently of each other. In other words, the outsole 30 serving as the ground contact portion 33*a* and the other outsole 30 are separated from each other.

Figure 4:
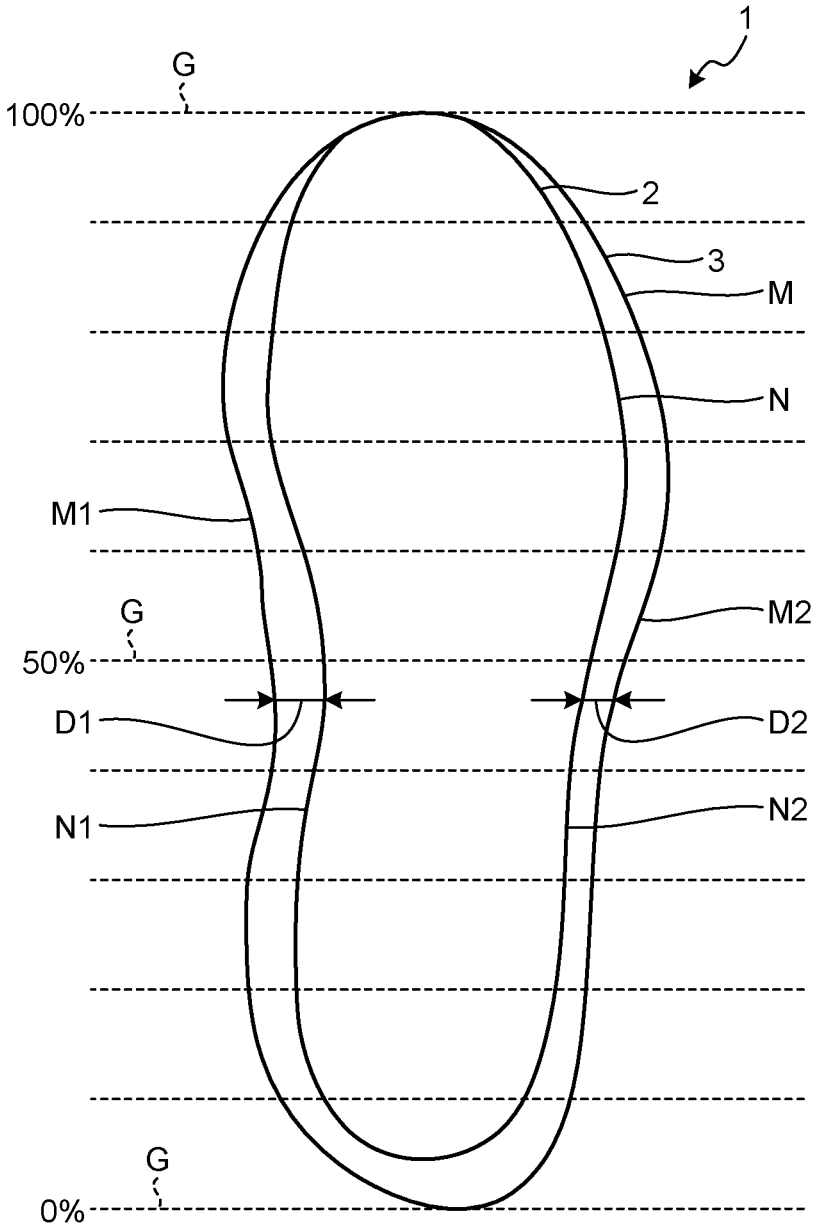
FIG. 4 is a bottom view schematically illustrating an outline and a fixed line of the shoe according to the first embodiment of the present invention.

FIG. 4 is a bottom view schematically illustrating a sole outline M and a fixed line N of the shoe 1 according to the first embodiment of the present invention. In FIG. 4, scale lines G are indicated in order to facilitate understanding. The scale line G at the position corresponding to the rear end of the sole 3 is defined as 0%, and the scale line G at the position corresponding to the front end of the sole 3 is defined as 100%. The scale line G is provided for each 10% of the dimension of the sole 3 in the front-rear direction. In a bottom view of the sole 3, when a line connecting the outermost portion of the sole 3 is defined as a sole outline M, and a line connecting the portion where the sole 3 and the upper 2 positioned above the sole 3 are fixed is defined as a fixed line N, the sole outline M extends so as to surround the periphery of the fixed line N. When a distance in the foot width direction between a medial-foot-side portion M1 of the sole outline M and a medial-foot-side portion N1 of the fixed line N is D1, and a distance in the foot width direction between a lateral-foot-side portion M2 of the sole outline M and a lateral-foot-side portion N2 of the fixed line N is D2, the distance D1 and the distance D2 at the same position of the sole 3 in the front-rear direction preferably satisfy a relationship of D1>D2 in a region ranging from 30% to 60% of the dimension of the sole 3 in the front-rear direction from the rear end of the sole 3. The distance D1 and the distance D2 more preferably satisfy the relationship D1>D2 in a region ranging from 20% to 80% of the dimension of the sole 3 in the front-rear direction from the rear end of the sole 3.

Next, effects of the sole 3 and the shoe 1 according to the present embodiment are described.

First, the inventors of the present invention conducted experiments focusing on the angle of falling of the foot, a body posture, and the like in a fatigued state after a person run a predetermined distance. Specifically, the inventors had the subjects run a distance of 20 km or more, and observed and compared the inclination angle of the body, the state of the foot in contact with the ground, and the like at the initial stage of running when they were not fatigued and at the time when they were fatigued after running nearly 20 km. From the experiments, the inventors found that as the fatigue level of the subjects increases, the midfoot of the foot tends to come into contact with the ground at the same time when the heel of the foot comes into contact with the ground, which causes the medial longitudinal arch to easily collapse and that the pressure on the midfoot of the foot to the forefoot becomes higher than the pressure on the heel of the foot when the inward falling of the foot is the largest between the ground contact and the foot off. Therefore, if it is possible to control the inward falling of the foot even in a fatigued state due to running, the effect of maintaining the stability of the foot of a runner at the time of ground contact during the running period is expected for a long time.

In the sole 3 according to the present embodiment, as illustrated in FIG. 2, the ground contact portion 33*a* having a portion positioned on the lowermost line Z connecting the lowermost point P1 of the forefoot support portion R1 and the lowermost point P2 of the rearfoot support portion R3 in a side view is formed in the medial-foot-side region of the bottom surface of the midfoot support portion R2. Since the medial longitudinal arch of the foot is supported from below by the ground contact portion 33*a*, it is possible to control the collapse of the medial longitudinal arch of the foot. In the present embodiment, as illustrated in FIG. 3, the medial-foot-side side surface of the midfoot support portion R2 is formed with the protrusion 33*b* protruding toward the medial foot side. Since the medial longitudinal arch of the foot is supported from the medial foot side by the protrusion 33*b*, it is possible to control the falling of the foot toward the medial foot side. That is, according to the present embodiment, it is possible to control the collapse of the medial longitudinal arch and the falling of the foot toward the medial foot side to stably support the midfoot of the sole of the wearer. To control the collapse of the medial longitudinal arch and the falling of the foot toward the medial foot side as in the present embodiment is particularly effective when a runner is increasingly fatigued. That is, it is possible to control overpronation under increased fatigue due to running.

In the present embodiment, as illustrated in FIG. 3, the protrusion 33*b* is formed on the medial-foot-side side surface of the midsole 31, and when a straight line connecting the medial-foot-side edge of the upper surface 31*a* of the midsole 31 and the medial-foot-side edge of the bottom surface 31*b* of the midsole 31 is defined as the virtual straight line L, the vertex 33*f* of the protrusion 33*b* is positioned on the medial foot side relative to the virtual straight line L and below the center of the virtual straight line L in the vertical direction. With this structure, it is possible to prevent the protrusion 33*b* from locally bending when the medial longitudinal arch of the foot is about to fall toward the medial foot side. That is, when the medial longitudinal arch of the foot is about to fall toward the medial foot side, the compressive deformation of the protrusion 33*b* can be promoted. Therefore, it is possible to further control the falling of the foot toward the medial foot side.

In the present embodiment, as illustrated in FIG. 3, the protrusion 33*b* includes the protruding end surface 33*c* facing the medial foot side, and the protruding end surface 33*c* has the first protruding end surface 33*d* extending upward from the medial-foot-side edge of the bottom surface 31*b* of midsole 31 so as to be positioned toward the medial foot side, and the second protruding end surface 33*e* continuous with the first protruding end surface 33*d* and extending upward so as to be positioned toward the lateral foot side. With this structure, the vertex 33*f* positioned at the boundary between the first protruding end surface 33*d* and the second protruding end surface 33*e* is positioned at a position separated upward from the ground, and it is possible to prevent the protrusion 33*b* from locally bending when the medial longitudinal arch of the foot is about to fall toward the medial foot side. That is, when the medial longitudinal arch of the foot is about to fall toward the medial foot side, the compressive deformation of the protrusion 33*b* can be promoted. Therefore, it is possible to further control the falling of the foot toward the medial foot side.

In the present embodiment, as illustrated in FIG. 4, in the region ranging from 30% to 60% of the dimension of the sole 3 in the front-rear direction from the rear end of the sole 3, the distance D1 in the foot width direction between the medial-foot-side portion M1 of the sole outline M and the medial-foot-side portion N1 of the fixed line N is longer than the distance D2 in the foot width direction between the lateral-foot-side portion M2 of the sole outline M and the lateral-foot-side portion N2 of the fixed line N. With this structure, the medial longitudinal arch of the foot is supported from the medial foot side by the sole 3, and it is possible to control the falling of the foot toward the medial foot side.

In the present embodiment, as illustrated in FIG. 1, the outsole 30 serving as the ground contact portion 33*a* and the other outsole 30 are provided independently of each other. With this structure, the load generated when the ground contact portion 33*a* comes into contact with the ground can be easily transmitted only to the second midsole portion 33 formed with the ground contact portion 33*a*, and it is possible to more reliably compress and deform the second midsole portion 33. Therefore, it is possible to enhance the cushioning property of the second midsole portion 33 of the sole 3 positioned below the medial longitudinal arch of the foot. In other words, it is possible for the second midsole portion 33 of the sole 3 positioned below the medial longitudinal arch of the foot to easily absorb an impact when the ground contact portion 33*a* comes into contact with the ground.

In the present embodiment, as illustrated in FIG. 3, the second midsole portion 33 positioned below the medial longitudinal arch where the wearer is likely to feel a thrust is formed separately from the first midsole portion 32, and the hardness of the second midsole portion 33 is lower than the hardness of the first midsole portion 32. With this structure, a thrust occurring when the shoe 1 comes into contact with the ground is less likely to be transmitted to the medial longitudinal arch of the foot, and it is possible to expect the effect of improving the comfort while the wearer runs.

In the present embodiment, as illustrated in FIG. 3, the upper surface 33*g* of the second midsole portion 33 is inclined downward from the medial foot side toward the lateral foot side. With this structure, the wearer is less likely to feel a thrust to the medial longitudinal arch of the foot, and it is possible to expect the effect of improving the comfort while the wearer runs.

Note that, as illustrated in FIG. 3, as long as the sole 3 includes the protrusion 33*b* protruding from the medial-foot-side side surface of the midfoot support portion R2 toward the medial foot side, the fall of the foot toward the medial foot side can be controlled. Therefore, the structure of the protrusion 33*b* is not limited to the illustrated example. For example, the vertex 33*f* of the protrusion 33*b* is preferably positioned below the center of the virtual straight line L in the vertical direction, but may be positioned at the same height as the center of the virtual straight line L in the vertical direction or above the center of the virtual straight line L in the vertical direction. For example, the shape of the protruding end surface 33*c* of the protrusion 33*b* is preferably the illustrated shape, but may be a linear shape along the vertical direction or may be a shape inclined from the upper side toward the lower side so as to be positioned toward the medial foot side.

In the above embodiment, as illustrated in FIG. 2, the ground contact portion 33*a* disposed in the midfoot support portion R2 is the outsole 30, but the ground contact portion 33*a* may be a part of the midsole 31. For example, a part or all of the bottom surface of the second midsole portion 33 may be served as the ground contact portion 33*a*. When the ground contact portion 33*a* disposed in the midfoot support portion R2 is a part of the midsole 31, the outsole 30 is only required to be disposed at least in the forefoot support portion R1 and the rearfoot support portion R3.

The bottom view shape of the second midsole portion 33 illustrated in FIG. 1, the side view shape of the upper surface 33*g* of the second midsole portion 33 illustrated in FIG. 2, and the cross-sectional shape of the upper surface 33*g* of the second midsole portion 33 along the foot width direction illustrated in FIG. 3 are not limited to the illustrated examples, and may be appropriately changed. For example, the cross-sectional shape of the upper surface 33*g* of the second midsole portion 33 along the foot width direction may be a flat shape along the foot width direction.

Second Embodiment

Figure 5:
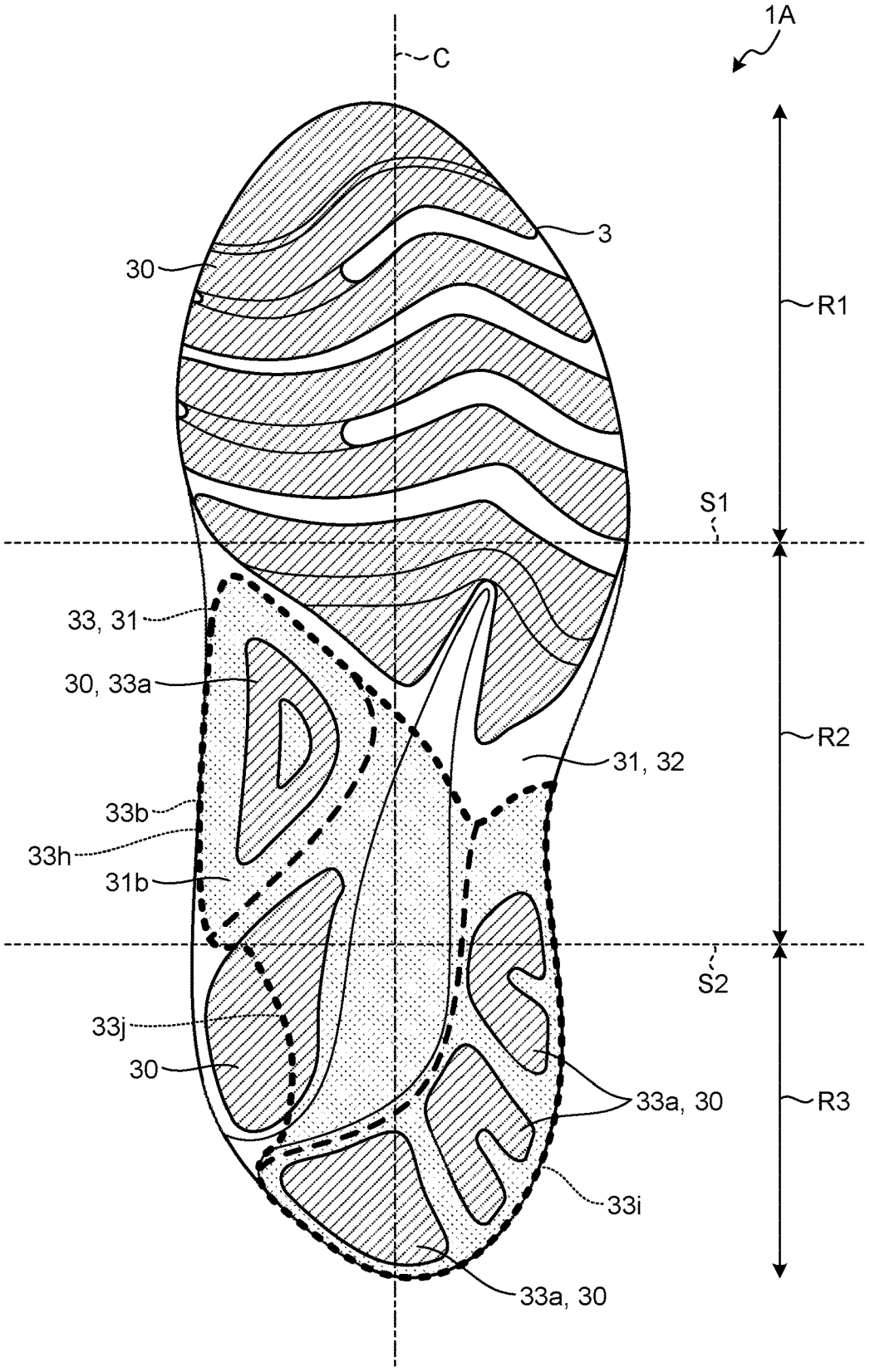
FIG. 5 is a bottom view of a shoe according to a second embodiment of the present invention.

FIG. 5 is a perspective view of a shoe 1A according to a second embodiment of the present invention. A shoe 1A according to the second embodiment is different from the shoe 1 according to the first embodiment in the range of a second midsole portion 33. In FIG. 5, the range of the second midsole portion 33 is indicated by a broken line.

The second midsole portion 33 is disposed from a medial-foot-side region of a midfoot support portion R2 to a lateral-foot-side region of a rearfoot support portion R3. The second midsole portion 33 includes a first portion 33*h*, a second portion 33*i*, and a third portion 33*j*. The first portion 33*h* is disposed in the medial-foot-side region of the midfoot support portion R2. The third portion 33*j* extends obliquely rearward from the first portion 33*h* toward the lateral foot side. The third portion 33*j* is disposed over a part of a central region of the midfoot support portion R2 in the foot width direction and a part of a central region of the rearfoot support portion R3 in the foot width direction. The second portion 33*i* extends from the third portion 33*j* rearward and toward the lateral foot side. The second portion 33*i* is disposed over a part of a lateral-foot-side region of the midfoot support portion R2, the lateral-foot-side region of the rearfoot support portion R3, and a heel-side region of the rearfoot support portion R3. The second portion 33*i* reaches the rear end of the rearfoot support portion R3. The second midsole portion 33 is disposed avoiding a medial-foot-side region of the rearfoot support portion R3.

A ground contact portion 33*a* is disposed on the bottom surface of the first portion 33*h* and the bottom surface of the second portion 33*i*. The ground contact portion 33*a* is disposed in the medial-foot-side region of the midfoot support portion R2 of the bottom surface of the second midsole portion 33 and in the lateral-foot-side region and the heel-side region of the rearfoot support portion R3 of the bottom surface of the second midsole portion 33. Note that the third portion 33*j* may be omitted. The second midsole portion 33 is only required to be disposed in the medial-foot-side region of the midfoot support portion R2 and the lateral-foot-side region of the rearfoot support portion R3. In the present embodiment, it is possible to achieve the same effects as those of the first embodiment described above.

In a heel-strike running method, the lateral-foot-side region of the rearfoot support portion R3 first comes into contact with the ground, and the lateral-foot-side region of the rearfoot support portion R3 toward the medial-foot-side region of the midfoot support portion R2 sequentially comes into contact with the ground. In the present embodiment, the second midsole portion 33 is disposed from the medial-foot-side region of the midfoot support portion R2 to the lateral-foot-side region of the rearfoot support portion R3. With this structure, it is possible to enhance the cushioning property of the medial-foot-side region of the midfoot support portion R2 as well as the cushioning property of the lateral-foot-side region of the rearfoot support portion R3. Therefore, it is possible to reduce the speed of the falling of the foot toward the medial foot side.

In the present embodiment, the second midsole portion 33 is disposed in the central region of the midfoot support portion R2 in the foot width direction and in the central region of the rearfoot support portion R3 in the foot width direction. With this structure, a wearer is less likely to feel a local thrust when the lateral-foot-side region of the rearfoot support portion R3 toward the medial-foot-side region of the midfoot support portion R2 sequentially comes into contact with the ground, and it is possible to expect the effect of improving the comfort while the wearer runs.

Third Embodiment

Figure 6:
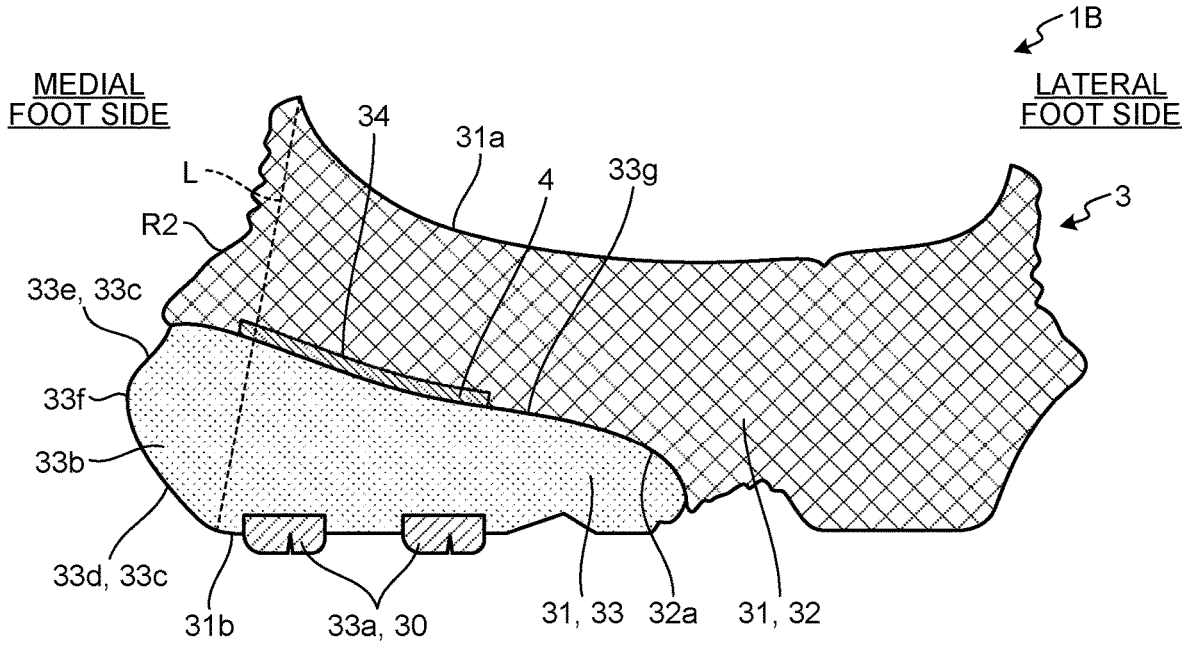
FIG. 6 is a cross-sectional view illustrating a shoe according to a third embodiment of the present invention and corresponds to a cross-sectional view taken along line III-III in FIG. 1.

FIG. 6 is a cross-sectional view illustrating a shoe 1B according to a third embodiment of the present invention and corresponds to a cross-sectional view taken along line III-III in FIG. 1. The shoe 1B according to the third embodiment is different from the shoe 1 according to the first embodiment in that a plate 4 is disposed between a first midsole portion 32 and a second midsole portion 33.

The plate 4 is disposed between the first midsole portion 32 and the second midsole portion 33. The plate 4 is disposed in a groove 34 formed in the bottom surface of the first midsole portion 32. The groove 34 is only required to be formed in one of the first midsole portion 32 and the second midsole portion 33. The hardness of the plate 4 is higher than the hardness of the first midsole portion 32 and the hardness of the second midsole portion 33.

The material of the plate 4 is, for example, short carbon fiber reinforced material, fiber reinforced resin, non-fiber reinforced resin, or fiber fabric material. The fiber reinforced resin is, for example, carbon fiber, glass fiber, aramid fiber, Dyneema fiber, Zylon fiber, or boron fiber. The non-fiber reinforced resin is, for example, polymer resin. The polymer resin is, for example, thermoplastic polyurethane (TPU) or thermoplastic elastomer (TPA). The fiber fabric material is, for example, knitted fabric or woven fabric of polyester fiber, nylon fiber, or the like. In the present embodiment, it is possible to achieve the same effects as those of the first embodiment described above.

In the present embodiment, the plate 4 is disposed between the first midsole portion 32 and the second midsole portion 33, and the hardness of the plate 4 is higher than the hardness of the first midsole portion 32 and the hardness of the second midsole portion 33. With this structure, the load generated when a ground contact portion 33*a* comes into contact with the ground can be easily transmitted to a wide range of the second midsole portion 33, and it is possible to compress and deform a wide range of the second midsole portion 33. Therefore, it is possible for the second midsole portion 33 of a sole 3 positioned below the medial longitudinal arch of a foot to easily absorb an impact when the ground contact portion 33*a* comes into contact with the ground.

Fourth Embodiment

Figure 7:
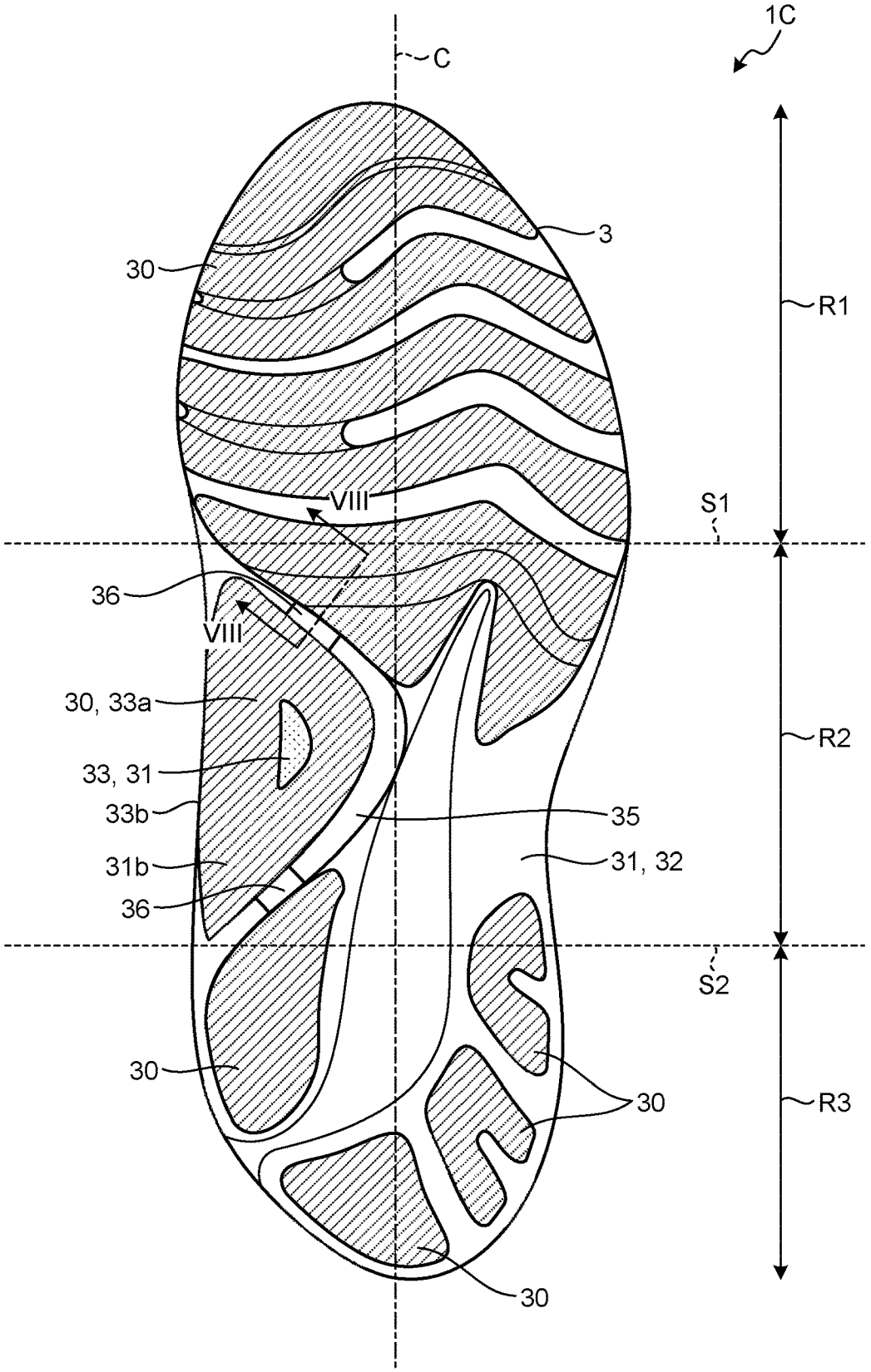
FIG. 7 is a bottom view of a shoe according to a fourth embodiment of the present invention.
Figure 8:
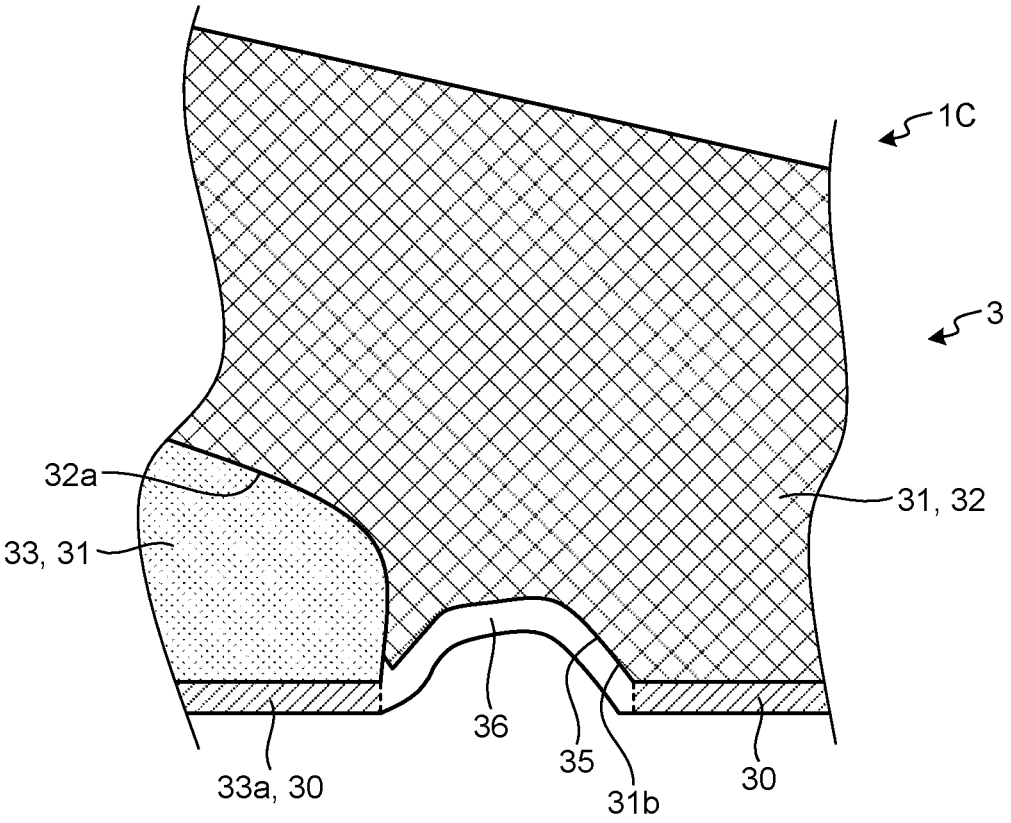
FIG. 8 is a cross-sectional view taken along line VIII-VIII in FIG. 7.

FIG. 7 is a bottom view of a shoe 1C according to a fourth embodiment of the present invention. FIG. 8 is a cross-sectional view taken along line VIII-VIII in FIG. 7. The shoe 1C according to the fourth embodiment is different from those according to the first to third embodiments in that at least a part of an outsole 30 serving as a ground contact portion 33*a* and at least a part of the other outsole 30 are connected to each other and that a portion where the outsole 30 serving as the ground contact portion 33*a* and the other outsole 30 are connected to each other is disposed in a recess 35. In the following description, the portion where the outsole 30 serving as the ground contact portion 33*a* and the other outsole 30 are connected to each other can also be referred to as a connecting portion 36. Although the connecting portion 36 is also the outsole 30, the connecting portion 36 is not hatched in FIGS. 7 and 8 in order to clarify the range of the connecting portion 36.

As illustrated in FIG. 8, a bottom surface 31*b* of a midsole 31 is formed with the recess 35 recessed upward. The recess 35 is formed on the bottom surface of a first midsole portion 32 in the present embodiment. As illustrated in FIG. 7, the recess 35 is disposed in a region in the periphery of the second midsole portion 33, excluding a region along the medial-foot-side edge. As illustrated in FIG. 8, the connecting portion 36 is disposed in the recess 35. In FIG. 8, a boundary between the outsole 30 serving as the ground contact portion 33*a* and the connecting portion 36, and a boundary between the other outsole 30 and the connecting portion 36 are indicated by broken lines. At least a part of the outsole 30 serving as the ground contact portion 33*a* and at least a part of the other outsole 30 are only required to be connected to each other. In the present embodiment, it is possible to achieve the same effects as those of the first embodiment described above.

In the present embodiment, the portion where the outsole 30 serving as the ground contact portion 33*a* and the other outsole 30 are connected to each other is disposed in the recess 35. With this structure, the load generated when the ground contact portion 33*a* comes into contact with the ground can be easily transmitted only to the second midsole portion 33 formed with the ground contact portion 33*a*, and it is possible to reliably compress and deform the second midsole portion 33. Therefore, it is possible for the second midsole portion 33 of a sole 3 positioned below the medial longitudinal arch of a foot to easily absorb an impact when the ground contact portion 33*a* comes into contact with the ground.

A sole of a shoe according to the present invention has an effect of controlling overpronation under increased fatigue due to running.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

A sole of a shoe according to a first aspect comprising: a forefoot support portion supporting a forefoot of a foot of a wearer; a midfoot support portion supporting a midfoot of the foot of the wearer; and a rearfoot support portion supporting a rearfoot of the foot of the wearer, the forefoot support portion, the midfoot support portion, and the rearfoot support portion being connected in order from a front side toward a rear side, wherein a ground contact portion having a portion positioned on a lowermost line connecting a lowermost point of the forefoot support portion and a lowermost point of the rearfoot support portion in a side view is formed in a medial-foot-side region of a bottom surface of the midfoot support portion, and a protrusion protruding toward a medial foot side is formed on a medial-foot-side side surface of the midfoot support portion.

The sole of the shoe of a second aspect according to the sole of the shoe of the first aspect, further comprising a midsole disposed over the forefoot support portion, the midfoot support portion, and the rearfoot support portion, wherein the protrusion is formed on a medial-foot-side side surface of the midsole, and when a straight line connecting a medial-foot-side edge of an upper surface of the midsole and a medial-foot-side edge of a bottom surface of the midsole is defined as a virtual straight line on a cross-section in width direction, a vertex of the protrusion is positioned on the medial foot side relative to the virtual straight line and below a center of the virtual straight line in a vertical direction.

The sole of the shoe of a third aspect according to the sole of the shoe of the second aspect, wherein the protrusion includes a protruding end surface facing the medial foot side, and the protruding end surface has a first protruding end surface extending upward from the medial-foot-side edge of the bottom surface of the midsole toward the medial foot side, and a second protruding end surface continuous with the first protruding end surface and extending upward toward a lateral foot side.

The sole of the shoe of a fourth aspect according to the sole of the shoe of the first or second aspects, wherein when a line connecting an outermost portion of the sole is defined as a sole outline and a line connecting a portion where the sole and an upper positioned above the sole are fixed is defined as a fixed line in a bottom view of the sole, the sole outline extends so as to surround a periphery of the fixed line, and in a region ranging from 30% to 60% of a dimension of the sole in a front-rear direction from a rear end of the sole, a distance in a foot width direction between a medial-foot-side portion of the sole outline and a medial-foot-side portion of the fixed line is longer than a distance in the foot width direction between a lateral-foot-side portion of the sole outline and a lateral-foot-side portion of the fixed line.

The sole of the shoe of a fifth aspect according to any one of the sole of the shoe of the second to fourth aspects, further comprising an outsole disposed at least in the forefoot support portion and the rearfoot support portion and disposed below the midsole, wherein the ground contact portion and the outsole are provided independently of each other.

The sole of the shoe of a sixth aspect according to any one of the sole of the shoe of the second to fourth aspects, further comprising an outsole disposed at least in the forefoot support portion and the rearfoot support portion and disposed below the midsole, wherein the bottom surface of the midsole is formed with a recess recessed upward, at least a part of the ground contact portion and at least a part of the outsole are connected to each other, and a portion where the ground contact portion and the outsole are connected to each other is disposed in the recess.

The sole of the shoe of a seventh aspect according to any one of the sole of the shoe of the second to sixth aspects, wherein the midsole has a first midsole portion disposed over the forefoot support portion, the midfoot support portion, and the rearfoot support portion, and a second midsole portion disposed at least in a medial-foot-side region of the midfoot support portion, disposed below the first midsole portion, and including the ground contact portion, and hardness of the second midsole portion is lower than hardness of the first midsole portion.

The sole of the shoe of a eighth aspect according to the sole of the shoe of the seventh aspect, wherein an upper surface of the second midsole portion is inclined downward from the medial foot side toward a lateral foot side.

The sole of the shoe of a ninth aspect according to the sole of the shoe of the seventh or eighth aspects, wherein a plate having hardness higher than hardness of the first midsole portion and hardness of the second midsole portion is disposed between the first midsole portion and the second midsole portion.

The sole of the shoe of a tenth aspect according to any one of the sole of the shoe of the seventh to ninth aspects, wherein the second midsole portion is disposed from the medial-foot-side region of the midfoot support portion to a lateral-foot-side region of the rearfoot support portion, and the ground contact portion is disposed in the medial-foot-side region of the midfoot support portion of the bottom surface of the second midsole portion and in the lateral-foot-side region of the rearfoot support portion of the bottom surface of the second midsole portion.

A shoe of a eleventh aspect: the sole of the shoe according to any one of claim 1; and an upper positioned above the sole of the shoe.

What is claimed is:

1. A sole of a shoe comprising: a forefoot support portion configured to support a forefoot of a foot of a wearer; a midfoot support portion configured to support a midfoot of the foot of the wearer; and a rearfoot support portion configured to support a rearfoot of the foot of the wearer, the forefoot support portion, the midfoot support portion, and the rearfoot support portion being connected in order from a front side toward a rear side, and a midsole disposed over the forefoot support portion, the midfoot support portion, and the rearfoot support portion, wherein a ground contact portion having a portion positioned on a lowermost line connecting a lowermost point of the forefoot support portion and a lowermost point of the rearfoot support portion in a side view is formed in a medial-foot-side region of a bottom surface of the midfoot support portion, the midsole has a first midsole portion disposed over the forefoot support portion, the midfoot support portion, and the rearfoot support portion, and a second midsole portion disposed at least in a medial-foot-side region of the midfoot support portion, disposed below the first midsole portion and above the ground contact portion, the second midsole portion includes a protrusion protruding toward a medial foot side, the protrusion being formed on a medial-foot-side side surface of the second midsole portion, and a hardness of the protrusion is lower than a hardness of the first midsole portion.

2. The sole of the shoe according to claim 1, wherein when a straight line connecting a medial-foot-side edge of an upper surface of the midsole and a medial-foot-side edge of a bottom surface of the midsole is defined as a virtual straight line on a cross-section in a width direction, a vertex of the protrusion is positioned on the medial foot side relative to the virtual straight line and below a center of the virtual straight line in a vertical direction.

3. The sole of the shoe according to claim 2, wherein the protrusion includes a protruding end surface facing the medial foot side, and the protruding end surface has a first protruding end surface extending upward from the medial-foot-side edge of the bottom surface of the midsole toward the medial foot side, and a second protruding end surface continuous with the first protruding end surface and extending upward toward a lateral foot side.

4. The sole of the shoe according to claim 2, wherein when a line connecting an outermost portion of the sole is defined as a sole outline and a line connecting a portion where the sole and an upper positioned above the sole are fixed is defined as a fixed line in a bottom view of the sole, the sole outline extends so as to surround a periphery of the fixed line, and in a region ranging from 30% to 60% of a distance in a front-rear direction from a rear end of the sole, a distance in a foot width direction between a medial-foot-side portion of the sole outline and a medial-foot-side portion of the fixed line is longer than a distance in the foot width direction between a lateral-foot-side portion of the sole outline and a lateral-foot-side portion of the fixed line at the same distance in the front-rear direction from the rear end of the sole.

5. The sole of the shoe according to claim 2, further comprising an outsole disposed at least in the forefoot support portion and the rearfoot support portion and disposed below the midsole, wherein the ground contact portion and the outsole are provided independently of each other.

6. The sole of the shoe according to claim 2, further comprising an outsole disposed at least in the forefoot support portion and the rearfoot support portion and disposed below the midsole, wherein the bottom surface of the midsole is formed with a recess recessed upward, at least a part of the ground contact portion and at least a part of the outsole are connected to each other, and a portion where the ground contact portion and the outsole are connected to each other is disposed in the recess.

7. The sole of the shoe according to claim 1, wherein an upper surface of the second midsole portion is inclined downward from the medial foot side toward a lateral foot side.

8. The sole of the shoe according to claim 1, wherein a plate having hardness higher than hardness of the first midsole portion and hardness of the second midsole portion is disposed between the first midsole portion and the second midsole portion.

9. The sole of the shoe according to claim 1, wherein the second midsole portion is disposed from the medial-foot-side region of the midfoot support portion to a lateral-foot-side region of the rearfoot support portion, and the ground contact portion is disposed in the medial-foot-side region of the midfoot support portion of the bottom surface of the second midsole portion and in the lateral-foot-side region of the rearfoot support portion of the bottom surface of the second midsole portion.

10. A shoe comprising: the sole of the shoe according to claim 1; and an upper positioned above the sole of the shoe.

* * * * *